United States Patent [19]

Richoux

[11] Patent Number: 5,075,903

[45] Date of Patent: Dec. 31, 1991

[54] INFANT PROTECTION HEADGEAR

[76] Inventor: Deborah D. Richoux, 53 Hermitage Dr., Marrero, La. 70072

[21] Appl. No.: 516,342

[22] Filed: Apr. 30, 1990

[51] Int. Cl.[5] ..... A42B 3/00

[52] U.S. Cl. ..... 2/411; 2/421

[58] Field of Search ..... 2/410, 411, 414, 417, 2/421, 422, 425, 185 R, 2

[56] References Cited

U.S. PATENT DOCUMENTS

| | | | |
|---|---|---|---|
| 1,072,321 | 9/1913 | Fitch | 2/413 |
| 1,532,037 | 3/1925 | Cahill | 2/2 |
| 2,121,702 | 6/1938 | Larkin | 2/3 |
| 2,546,842 | 3/1951 | Yealdhall | 2/425 |
| 2,907,138 | 10/1959 | Kolwicz | 2/185 R |
| 2,969,547 | 1/1961 | Dye | 2/3 |
| 3,314,077 | 4/1967 | Marchello | 2/421 |
| 3,555,561 | 4/1969 | Neis | 2/3 |
| 4,062,067 | 12/1977 | Franzen | 2/410 |
| 4,279,038 | 7/1981 | Bruckner et al. | 2/425 |
| 4,581,773 | 4/1986 | Cunnane | 2/204 |
| 4,613,993 | 9/1986 | Steele et al. | 2/411 |
| 4,745,637 | 5/1988 | Steele et al. | 2/411 |

FOREIGN PATENT DOCUMENTS

| | | | |
|---|---|---|---|
| 271971 | 2/1930 | Italy | 2/421 |
| 295675 | 10/1936 | Italy | 2/414 |

*Primary Examiner*—Werner H. Schroeder
*Assistant Examiner*—Michael A. Neas
*Attorney, Agent, or Firm*—C. Emmett Pugh

[57] ABSTRACT

An infant protection device configured to comfortably yet effectively protect the rear, side and front portions of an infant's head from injury. An alternative embodiment of the present invention additionally provides head protection for the top of the infant's head, as well as for the front, sides and back. The present invention is designed to protect the infant's head during daily activities, such as crawling, walking, and playing, preventing injury due to the infant hitting its head on furniture, floor, etc. The invention is configured and designed such that the child wears it early in infancy, and, becoming used to it, should want to continue to wear the device. The headgear of the present invention may be configured to include such fanciful figures as, for example, mouse or rabbit ears, or other novel designs which may be enjoyed by the child, thereby further encouraging wearing of the protective device. The device is adjustable, lightweight, and comfortably worn, and yet it inexpensively and effectively provides protection against light to moderate impact injury to the infant's head, and is configured for the infant's daily use.

4 Claims, 2 Drawing Sheets

INFANT PROTECTION HEADGEAR

BACKGROUND of INVENTION

1. Field of Invention

The present invention relates to infant protection headgear and more particularly to a device configured to comfortably yet effectively protect the rear, side and front portions of an infant's head from injury. In particular, the present invention is configured to provide padded protection to the occipital area of the skull, wherein an infant or young child is likely to strike his head if he fell backwards while learning to walk. An alternative embodiment of the present invention provides head protection for the top of the infant's head, as well as the front, sides and rear of the head.

The present invention is designed for protecting the infant's head during daily activities, such as, for example, learning to sit upright, crawling, walking, and playing, preventing injury due to the infant hitting its head on furniture, the floor, vertical barriers, etc.

The invention is configured and designed such that the child wears it early in its infancy, and, becoming used to it, should want to continue to wear the device. The headgear of the present invention may be configured to include such fanciful figures as, for example, mouse or rabbit ears, or other novel designs which may be enjoyed by the child, thereby further encouraging the wearing of the protective device.

The present invention is truly new, unique, and utilitarian, and is fully distinguishable from the prior art devices, which comprise uncomfortable, restricting devices which were not primarily designed for comfort and enjoyment, as well as protection of the infant. The device can also be well used by invalids.

The preferred, exemplary embodiment of the present invention is adjustable, lightweight, and comfortably worn, and yet it inexpensively and effectively provides protection against light to moderate impact injury to an infant's head, and is configured for the infant's daily use.

2. Prior Art & General Background

The prior art has failed to contemplate a comfortable, lightweight, enjoyable infant head protection device, which is designed for use in the home during activities such as play, crawling, and learning to walk.

A list of prior patents which may be of interest is presented below:

| U.S. Pat. No. | Patentee(s) | Issue Date |
|---|---|---|
| 1,072,321 | B. G. Fitch | Sept 02, 1913 |
| 2,121,702 | E. Larkin | June 21, 1938 |
| 2,969,547 | E. R. Dye | Jan. 31, 1961 |
| 3,555,561 | H. B. Neis | Apr. 25, 1969 |
| 4,279,038 | Bruckner et al | Jul. 21, 1981 |
| 4,581,773 | Cunnane | Apr. 15, 1986 |
| 4,745,637 | Steele et al | May 24, 1988 |

Of the above cited prior art, only the Steele, Fitch, and Cunnane references teach a head protection device specifically designed for an infant or very young child. The remaining references teach headgear designed in conjunction with non-analogous athletic activities, such as baseball and contact sports.

The Steele reference teaches headgear comprising a plurality of padded "rings," which are arranged to offer protection about the top and sides of the head. Conversely, the Fitch reference contemplates a much simpler, soft rubber, "pneumatic" air cushioning system comprising a single tubular head ring for supporting the sides of the head, and two tubular bands configured to fit across the upper head for protection.

While the Fitch reference might be considered to be better than no protection at all, it lacks sufficient protective surface area to prevent injury to an infant due to falling on the sides and, more particularly, the rear of the head.

The Cunnane reference is distinguishable from all of the above, teaching a padded "bonnet" of impact absorbent foam encapsulated forming the core of the hat and surrounded by durable textile fabric. It is questionable as to whether the Cunnane device could be made sufficiently padded for protection and yet remain comfortable and affordable, as achieved in the present invention.

Further, the Cunnane device when worn could impair audio-sensory development of the infant, due to the ears being covered, if worn for long periods of time, and also restrict movement of the infant in the head area.

Unlike the present invention, the prior art has failed to contemplate a device which comfortably, effectively, and attractively provides infant head protection for extended periods of time in a fun, enjoyable manner for the infant, without impairing sensory development. Indeed, the only infant headgear contemplated by the prior art appears to be all uncomfortable, bulky, restrictive, and certainly not enjoyable to wear, as is the present invention. Further, the prior art has failed to teach headgear particularly suited for protecting the occipital region of the skull, the prior art teaching protection of the upper skull area above the ears, but not providing padded protection for the lower rear portion of the head.

3. General Summary Discussion of the Invention

The present invention overcomes these prior art problems by providing a system which is highly reliable, relatively economical and of cost effective construction, without any restriction of audio visual development.

As is well known, an infant's head area is particularly prone to injury due to the fact that the infant's skull often has not completely fused or is otherwise rather undeveloped after birth, coupled with the fact that infants lack significant motor skills. Therefore, the typical infant must often sustain multiple falls, often on hard floors, before it can learn to sit, crawl and walk without falling.

The area to the back of the infant's head which is liable to sustain injury should he fall backwards is known as the occipital area of the skull. A massive impact to the area, conceivably the result of a backwards fall to a hard floor, could result in a subdural hematoma, skull fracture, or other serious injury. As the occipital area encompasses the lower rear and mid skull area, the prior art would not provide sufficient protection, only protecting the upper rear skull area at best. This leaves the lower occipital area, including that area of the skull occupied by the brain stem, exposed to potential injury should a backward fall occur. The present invention is specifically designed to protect the occipital area from such injury.

Further, the infant's head size, when compared to its body, tends to be proportionally larger than that of older individuals. This, coupled with the child's weak muscular system, particularly in the neck, is often the cause of head injury to infants in their crawling, playing, or other activities. These injuries may be minor to severe, yet almost all are avoidable with proper protection.

However, the prior art, until now, has failed to design infant protection headgear which is effective yet voluntarily worn by the infant in an pleasurable fashion. It is important that the headgear be voluntarily worn, as the infant will often refuse to wear headgear if it is uncomfortable or restrictive, often causing injury due to its size and weight, and not appealing to the child. Further, the headgear could conceivably stifle development of the child if it were overly heavy or restrictive, preventing the child from engaging in self learning activities, such as depth perception, distance approximation, audio perception, etc.

The present device overcomes the prior art problems associated with infant headgear, providing a lightweight, effective, low cost, and realistically designed device that may be worn daily by the infant with no developmental hinderance, and in fact enjoyed by the child during use in terms of its appearance and feel.

The preferred embodiment of the present device comprises a padded headband having a padded "saucer" shaped portion to protect the rear of the child's head, as well as an elastic chin strap and adjustable head strap. An alternative embodiment of the present invention further provides a ventilated padded head strap and a ventilated half circle portion on each side.

As indicated above, the present invention may include animal ears or other fanciful items sewn to the device, as well as incorporate novelty exterior fabric with designs of animals' faces, etc.

The headband in the exemplary embodiment of the present invention comprises quilted cotton fabric, as does the rear "saucer" portion along with polyester fiberfill therebetween.

It is thus an object of the present invention to provide an infant protection device for the head of an infant or small child.

It is a further object of the present invention to provide an infant protection device which is economical to manufacture, lightweight, and comfortable to wear.

It is a further object of the present invention to provide an infant protection device which is designed to encourage the infant to wear it in the infant's daily activities.

It is a still further object of the present invention to provide an infant protection device which is designed to support novel designs such as animal ears and the like to encourage infant use and enjoyment.

It is still further object of the present invention to provide an infant protection device which is configured to provide padded protection to the occipital area of the skull.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENTS

Figure 1:
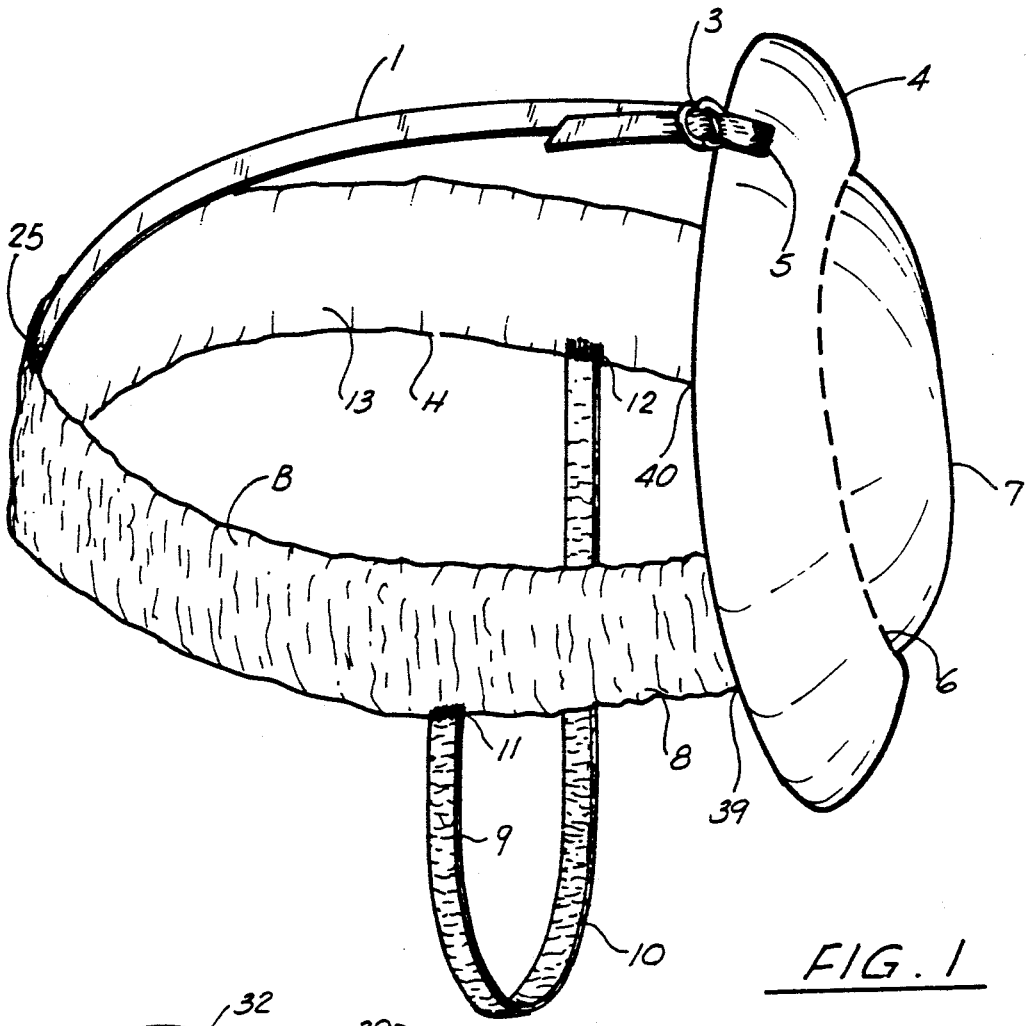
FIG. 1 is a side, perspective view of the preferred embodiment of the headgear protection device of the present invention.
Figure 3:
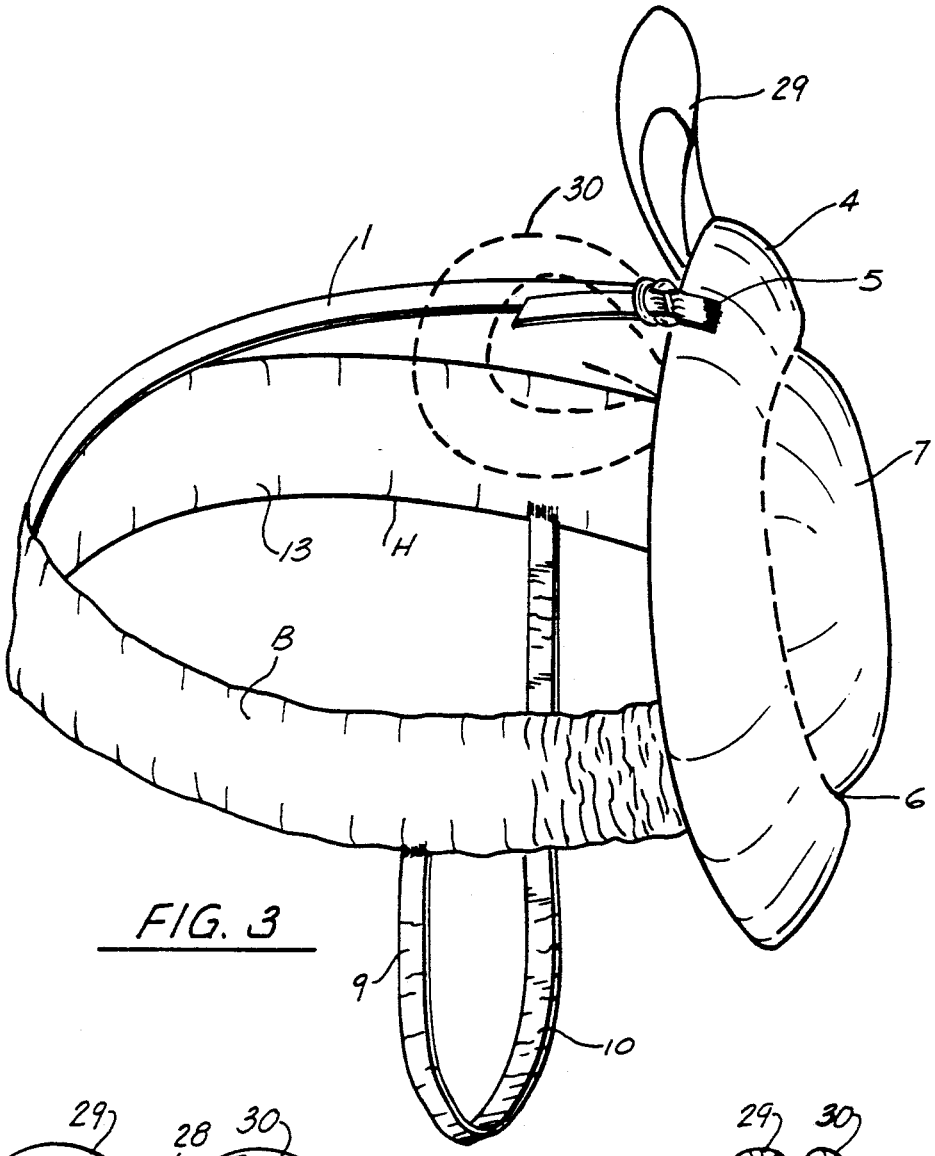
FIG. 3 is a side, perspective view of the preferred embodiment of the headgear protection device of the present invention of FIG. 1, illustrating the placement and configuration of decorative ears, one in phantom.

As can be seen in FIGS. 1 & 3, the infant protection headgear H (termed "Baby Bumps" TM) of the preferred, exemplary embodiment of the present invention, includes a padded headband B of quilted, heavy cotton fabric or the like formed into a tubular band, and having a polyester fiber fill therein for padding.

The distal sides of the headband B are connected via a multiple stitch chin strap 9, comprising in the preferred embodiment a strip of gathered ribbon over elastic 10. Chin strap 9 is affixed to the lower area of the headband B at two points 11 & 12, respectfully. While the chin strap 9 in the exemplary embodiment is fixed to headband B, it is noted that alternative embodiments might use snap, "VELCRO™" type material, button, or related means for removably affixing the chin strap thereto.

Affixed to the upper, frontal area of the headband B at area 2 is the head strap 1. The head strap 1 comprises a strip of ribbon of sufficient length and width to join connection means, in the present embodiment, in the form of rings 3. The rings 3 are in turn affixed to a rear head pad 4 via connection strap 5.

As denoted in the drawings, the rear head pad 4 is affixed to the ends of the head band at points 39, 40 so as to form a head cushion. Incorporated into the headband B near the headband connection points 39, 40 in an area of the headband B, the outer fabric is gathered over an elastic, forming itself into an elastic area, thereby providing snug means of wearing the headband for a variety of size heads.

Like headband B, the rear head pad 4 preferably comprises an outer, quilted fabric of cotton or the like, formed in a discconfigured pad, and wrapped about a polyester fiberfill padding. The pad may include a circular stitched dart 6, forming an inner (7) and outer pad for increased padding and better appearance.

About the periphery of rear head pad 4 and along the inner wall 13 of head band B, the present embodiment preferably includes a satin top stitched with thread for strength, durability and aesthetic appearance.

Figure 2:
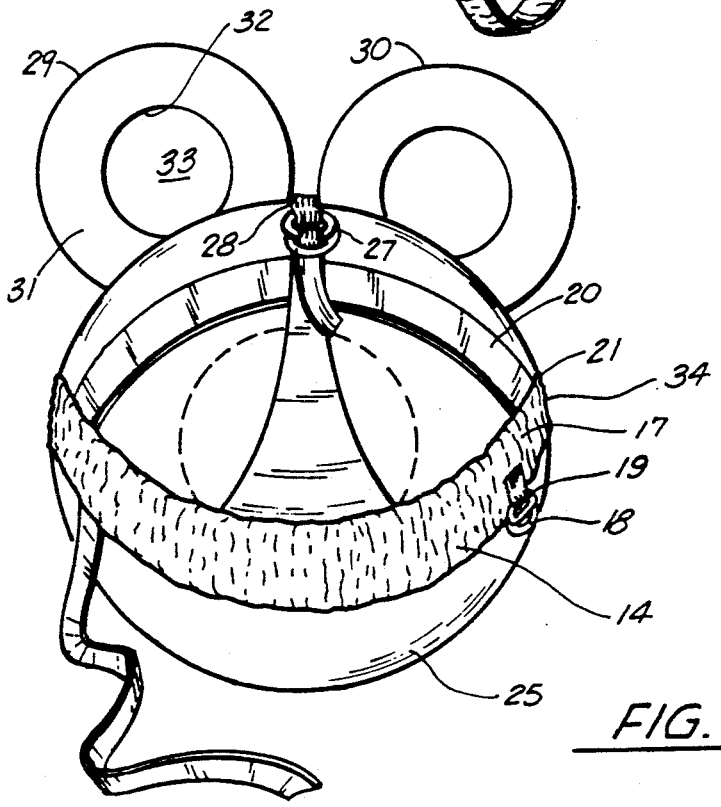
FIG. 2 is a frontal, perspective view an alternative embodiment of the headgear protection device of FIG. 1.

FIG. 2 of the drawings illustrates an alternative embodiment 14 of the present invention, illustrating the inclusion of a novel pair of animal ears, here, in the form of mouse or bear ears 29, 30, stitched to the upper periphery of rear head pad 25. Ears 29 & 30 comprise, like the rear pad, an outer cotton, quilted fabric forming the rear wall of ears, and, forming the front wall of the ears, is a heavier, felt-like fabric of polyester or the like. In the present invention, the ears comprise a front wall of two different color cloths, forming inner (33) and outer (31) portions of ear 30, the two cloths being joined via a dart 32.

FIG. 3 further illustrates the placement and configuration of decorative ears 29, 30 upon rear head pad 4, as an addition to the basic headgear design to encourage infant and child enjoyment of the device.

As further illustrated in FIG. 2, the chin strap 15 comprises a non-elastic ribbon affixed to the lower side portion of the headband 14 via a dart 36. Chin strap 15 is tapered at area 37 so as to communicate with rings 18, which are in turn affixed to the headband 16 via a ring strap 19.

Like the preferred embodiment, the alternative embodiment of the present invention can utilize a gathered headband area 17, with a large rear head pad 25 affixed to the distal ends of the headband areas 34, 35. Again like the preferred embodiment, the alternative embodiment can use a center stitched dart 26 on the rear head pad 25 for increased padding and better appearance. The construction of rear head pad 25 is similar to that contemplated in the preferred embodiment, with the inclusion of ears 29, 30 discussed above, as well as the inclusion of a polyester fiberfill cushioning between the fabric walls.

The alternative embodiment of the present invention further includes an adjustable, cushioned head strap distinguishable from that contemplated in the preferred embodiment. As illustrated in FIG. 2, the head strap means in the alternative embodiment comprises a first head strap 20 made of a ribbon strap satin stitched to distal sides 21, 22 of the headband 16. Also connected by gathered ribbon over elastic with a short portion of ribbon sewn to the underside constructing a containment glide area for head strap 23.

The head strap means in this alternative embodiment further includes a second head strap 23, which is adjustable and padded at area 23. The second head strap 23 is somewhat tapered in overall configuration, having a wide end and a narrow end, the wide end being affixed to the front portion 24 of the headband 16 ventilated headband, the distal, narrow end 38 being of such a length and configuration as to readily pass through the securing rings 27, which are in turn affixed to the rear head pad 25 via a ring strap 28 or, for further example, "VELCRO™" type material may be used.

As stated above, this second head strap 23 is adjustable via the strap 38/ring 27 arrangement and is padded. The padding arrangement may be the same fabric/-polyester fiber fill construction as contemplated for the rear head pad 25 supra, but of course in the tapered configuration discussed above.

The padded head strap of the alternative embodiment is designed to prevent injury to the top of the head of the wearer due to hitting the bottom face of a table or any similar collisions which might occur in play. Further, the padded head strap may provide some protection to the infant or child due to an object inadvertently falling upon the head of the wearer.

Figure 4:
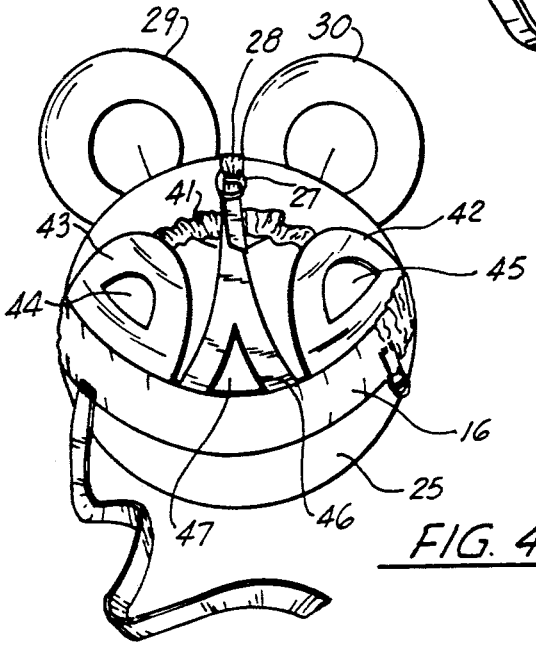
FIG. 4 is a frontal, perspective view of a further alternative of the headgear protection device of FIG. 2, illustrating the configuration and placement of side pads, and an alternative second head strap having a ventilation opening.

A second alternative to the present invention is illustrated in FIG. 4, wherein the headgear further includes side pads 42, 43 affixed to headband 16, each pad further including ventilation holes 44, 45. The side pads 42, 43 provide additional upper head protection and are desirable wherein the child is apt to strike his head on the underside of tables and the like during the crawling-/early walking stage. First head strap 41 is sewn to the upper areas of the side pads 42, 43 and communicates with second head strap 46, joining the pads.

Figure 5:
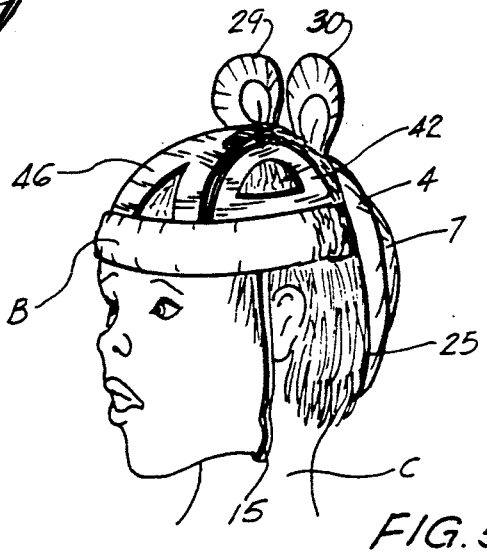
FIG. 5 teaches a isometric view of the infant headgear device of FIG. 4, illustrating the device as worn by a child.

As illustrated in FIG. 5, in use, the present invention is generally adjusted to the approximate size of the head of the infant wearer and then placed thereupon, wherein it is further adjusted upon the wearer's head so that it is comfortable and unencumbering. Depending upon the embodiment worn, the chin strap and/or the head strap may or may not have to be adjusted.

The invention is placed upon the head such that the rear head pad 4, 25 is placed to the rear of the head, providing padded protection to the occipital and surrounding region of the skull, and the headband portions B, 16 communicate with the forehead and sides of the head. Head straps 15 should be adjusted to communicate with the top of the head, so as to prevent the headband portions B, from slipping down the forehead, across the face of the wearer as a child tends to pull things down.

As worn, the alternative embodiment of the invention incorporating decorative ears 29, 30 serves as both a means of protection and a pleasurable "toy," wherein the wearer sports animal ears such as those of a mouse, rabbit, or the like.

The rear pad 4, 25 is designed to protect against head injury due to the wearer's falling backward and striking her head against the ground, or collisions with furniture, walls and the like during walking, crawling, or similar activities.

The headband portions B are designed to protect against light head injury due to, for example, falling face forward, or striking the side of the head against the floor, furniture, walls during similar walking or crawling type activities. The gathered head band in both embodiments disclosed above, in conjunction with their respective head and chin straps, comfortably but securely maintains the protective device in place.

The dimensions of the exemplary embodiment as illustrated in FIG. 3 are as follows:

Diameter of rear pad 4—7 inches
Thickness of rear pad and center pad 7—approx. 1 inch
Length of headband B—approximately 17 inches,
Thickness of headband B—approximately 1 inch
Dimensions of ears 29, 30—$\frac{1}{8}'' \times 2.5'' \times 3''$
Length of head strap 1—approx. 7 inches
Length of chin strap 9—approx. 8 inches The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A device for wearing about the head for protecting the forehead, sides, and back of the head, particularly the occipital region of the skull, of an infant or young child, comprising:

a padded headband having an inner wall, an outer wall, an upper area, a lower area, a front area, first and second rear ends, and first and second sides;

a somewhat disc configured, rear head pad having a peripheral top, bottom, first and second side edges about its circumference, said disc configured, rear head pad being affixed at its first and second side edges to said first and second rear ends of said padded headband, respectively, said disc configured, rear head pad being configured in perpendicular fashion relative to said padded headband, said disc configured rear head pad of dimensions to cover at least the occipital region of the skull of the wearer;

head strap means for securing said padded headband about the head of the wearer;

chin strap means for maintaining the device upon the head of the wearer, said chin strap means having a first end and a second end, said first end being affixed to said first side of said headband, and said second end affixed to said second side of said headband, said chin strap means further comprising a strap or ribbon having first and second ends, said first end being affixed to said first side of said headband; and ribbon retaining means for retaining said ribbon, said ribbon retaining means being affixed to said second side of said headband, said ribbon retaining means comprises at least one retaining ring affixed to a retaining ring strap, said retaining ring being configured to communicate with and retain said second end of said chin strap means.

2. A device for wearing about the head for protecting the forehead, sides, and back of the head, particularly the occipital region of the skull, of an infant or young child, comprising:

a padded headband having an inner wall, an outer wall, an upper area, a lower area, a front area, first and second rear ends, and first and second sides;

a somewhat disc configured, rear head pad having a peripheral top, bottom, first and second side edges about its circumference, said disc configured, rear head pad being affixed at its first and second side edges to said first and second rear ends of said padded headband, respectively, said disc configured, rear head pad being configured in perpendicular fashion relative to said padded headband, said disc configured rear head pad of dimensions to cover at least the occipital region of the skull of the wearer;

head strap means for maintaining the device upon the head of the wearer, said head strap means having a first and second end, said first end being affixed to said front of said headband and said second end being affixed to said top, peripheral edge of said disc configured, rear head pad;

strap retaining means for retaining said strap, said strap retaining means affixed to said top peripheral edge of said disc configured, rear head pad and comprised of at least one retaining ring affixed to a retaining ring strap, said retaining ring configured to communicate with and retain said second end of said head strap means.

3. A device for wearing about the head for protecting the forehead, sides, and back of the head, particularly the occipital region of the skull, of an infant or young child, comprising:

a padded headband having an inner wall, an outer wall, an upper area, a lower area, a front area, first and second rear ends, and first and second sides;

a somewhat disc configured, rear head pad having a peripheral top, bottom, first and second side edges about its circumference, said disc configured, rear head pad being affixed at its first and second side edges to said first and second rear ends of said padded headband, respectively, said disc configured, rear head pad being configured in perpendicular fashion relative to said padded headband, said disc configured rear head pad of dimensions to cover at least the occipital region of the skull of the wearer;

head strap means for securing said padded headband about the head of the wearer, said head strap means further includes first and second side pads.

4. A device for wearing about the head for protecting the forehead, sides, and back of the head, particularly the occipital region of the skull, of an infant or young child, comprising:

a padded headband having an inner wall, an outer wall, an upper area, a lower area, a front area, first and second rear ends, and first and second sides;

a somewhat disc configured, rear head pad having a peripheral top, bottom, first and second side edges about its circumference, said disc configured, rear head pad being affixed at its first and second side edges to said first and second rear ends of said padded headband, respectively, said disc configured, rear head pad being configured in perpendicular fashion relative to said padded headband, said disc configured rear head pad of dimensions to cover at least the occipital region of the skull of the wearer;

head strap means for securing said padded headband about the head of the wearer, appendages having the appearance of animal ears, said appendages being situated on said peripheral edge of said disc configured, rear head pad, said appendages being equilaterally spaced relative to said top peripheral edge of said disc configured, rear head pad.

* * * * *